US011109146B2

(12) United States Patent
Goller

(10) Patent No.: US 11,109,146 B2
(45) Date of Patent: Aug. 31, 2021

(54) LOUDSPEAKER WITH MULTI-OPERATING MODES AND BASS ENHANCEMENT

(71) Applicant: Harman Becker Automotive Systems GmbH, Karlsbad (DE)

(72) Inventor: Lars Goller, Herning (DK)

(73) Assignee: Harman Becker Automotive Systems GmbH

( * ) Notice: Subject to any disclaimer, the term of this patent is extended or adjusted under 35 U.S.C. 154(b) by 0 days.

(21) Appl. No.: 16/583,629

(22) Filed: Sep. 26, 2019

(65) Prior Publication Data

US 2020/0100023 A1 Mar. 26, 2020

(30) Foreign Application Priority Data

Sep. 26, 2018 (EP) ..... 18196901

(51) Int. Cl.
*H04R 1/28* (2006.01)
*H04R 1/02* (2006.01)
*H04R 3/00* (2006.01)

(52) U.S. Cl.
CPC ..... *H04R 1/2826* (2013.01); *H04R 1/025* (2013.01); *H04R 3/00* (2013.01); *H04R 2420/09* (2013.01); *H04R 2499/13* (2013.01)

(58) Field of Classification Search
CPC ..... H04R 5/02; H04R 1/2826; H04R 1/025; H04R 3/00; H04R 2420/09; H04R 2499/13; H04B 1/082
USPC ..... 381/86, 302, 389
See application file for complete search history.

(56) References Cited

U.S. PATENT DOCUMENTS

| | | | | |
|---|---|---|---|---|
| 5,714,721 | A | 2/1998 | Gawronski et al. | |
| 7,500,747 | B2 * | 3/2009 | Howell | G02C 11/06 351/158 |
| 2005/0013459 | A1 * | 1/2005 | Maekawa | B60R 11/0217 381/349 |
| 2010/0091997 | A1 | 4/2010 | Tiwari | |
| 2010/0092006 | A1 * | 4/2010 | Rosen | H04R 1/2834 381/86 |
| 2014/0262598 | A1 * | 9/2014 | Miki | H04R 1/2826 181/156 |
| 2017/0251305 | A1 * | 8/2017 | Fathollahi | H04R 1/025 |

FOREIGN PATENT DOCUMENTS

| | | | |
|---|---|---|---|
| EP | 3334178 | A1 | 6/2018 |
| WO | 9905887 | A1 | 2/1999 |
| WO | 2008051858 | A2 | 5/2008 |
| WO | 2013010017 | A1 | 1/2013 |
| WO | 2016098068 | A1 | 6/2016 |

* cited by examiner

*Primary Examiner* — William A Jerez Lora
(74) *Attorney, Agent, or Firm* — Angela M. Brunetti

(57) ABSTRACT

A portable loudspeaker having a sound generating unit configured to output a sound signal with a stand-alone frequency characteristic when the portable loudspeaker is used in a stand-alone operating mode and to output a sound signal with a connected frequency characteristic when the portable loudspeaker is used in a connected operating mode. The connected operating mode is defined when the portable loudspeaker is received by a docking module in a vehicle and is configured to enhance a bass output as compared to the stand-alone frequency characteristic.

15 Claims, 5 Drawing Sheets

LOUDSPEAKER WITH MULTI-OPERATING MODES AND BASS ENHANCEMENT

CROSS REFERENCE

Priority is claimed to European Application serial no. 18 196 901.5, filed Sep. 26, 2018, the disclosure of which is incorporated in its entirety by reference.

TECHNICAL FIELD

The disclosure relates to a portable loudspeaker configured to output a sound signal, to a vehicle docking module and to a system comprising the portable loudspeaker and the vehicle docking module.

BACKGROUND

From a physical point of view, portable loudspeakers with a small membrane and a low depth are not able to generate a change in volume needed for the playback of low-frequency sound signals. In other words, one can say, that small portable loudspeakers are unable to provide enough bass.

Furthermore, passive radiators are known in portable loudspeakers to increase the low-frequency response or the bass components of the portable loudspeaker. A passive radiator usually only includes a membrane, a suspension and a frame. When the passive radiator moves, it creates sound frequencies as a normal portable loudspeaker does. However, in a vehicle environment, passive radiators can be hardly used as movements occurring in the vehicle may cause an unwanted movement of the passive radiator.

Furthermore, portable loudspeakers became popular over the last years, especially in connection with the possibility of storing music signals in small devices wherein Bluetooth technology is used to couple the portable loudspeaker to a sound signal source. Due to the size of portable loudspeakers the possibility to output low-frequency components is limited.

Accordingly, a need exists to be able to use a portable loudspeaker with an enhanced bass output.

SUMMARY

This need is met by the features of the independent claims. Further aspects are described in the dependent claims.

According to first aspect a portable loudspeaker configured to output a sound signal is provided wherein the portable loudspeaker comprises a housing, a sound generating unit configured to output the sound signal with a stand-alone frequency characteristic when the portable loudspeaker is used in a stand-alone operating mode. The portable loudspeaker furthermore comprises a port comprising an opening to a space outside of the housing. The port allows a circulation of air through the opening when the portable loudspeaker is operating in a connected operating mode in which the portable loudspeaker is connected through the port to a first tube provided in a vehicle, wherein in the connected operating mode the portable loudspeaker is configured to output the sound signal with a connected frequency characteristic using the sound generating unit of the portable loudspeaker and the first tube provided in the vehicle to which the portable loudspeaker is connected through the port. The connected frequency characteristic comprises an enhanced bass output compared to the stand-alone frequency characteristic.

The portable loudspeaker can be used in a stand-alone operating mode in the portable loudspeaker can act as a normal portable loudspeaker outputting a sound signal having a certain frequency characteristic, namely a stand-alone frequency characteristic meaning that it is used without other components to generate the sound signal. The port allows to connect the portable loudspeaker to the first tube provided in a vehicle, especially located behind a vehicle panel, so that the Helmholtz resonance can be used in order to generate sound output using the sound generating unit of the portable loudspeaker and the first tube in order to provide a bass enhanced output, meaning an signal characteristic where the signal pressure level in a frequency range between 30and 100 Hz especially between 30 and 60 is higher compared to the stand-alone frequency characteristic. The theory behind the Helmholtz resonance is known and it is possible to determine based on the volume of the cavity and the dimension of the port through which the air enters the cavity, which frequency the generated sound signal has. In order to provide a frequency enhancement in the range below 60 Hz, by way of example in the range between 30 and 60 Hz a port is normally necessary in the range of more than 1 meter. This may be possible in a vehicle environment, however, the inventors have found that a smaller volume of the first tube and of the port is possible without disturbing higher frequency noise components as the vehicle surrounding components such as the vehicle compartment or any vehicle panel or seat cushion etc. located between the user of the portable loudspeaker and the portable loudspeaker suppresses the unwanted higher signal components and only let past the lower frequency components, especially the frequency components below 60 Hz without major losses.

Furthermore, a vehicle docking module is provided comprising a connecting port provided in the vehicle, wherein the connecting port is configured to connect sound waves of the portable loudspeaker in the connected operating mode of the portable loudspeaker. The vehicle docking module furthermore comprises a first tube connected to the connecting port and provided behind an inner panel provided inside the vehicle, the first tube being configured to let sound waves emitted by the portable loudspeaker pass inside the first tube in the connected operating mode. Furthermore, a positioning element is provided and arranged relative to the connecting port such that only a single orientation of the portable loudspeaker is allowable when the portable loudspeaker is connected to the connecting port. Furthermore, a support structure is provided with support walls configured to keep the portable loudspeaker at a fixed position relative to the connecting port. The support walls are configured such that the portable loudspeaker is kept in a fixed position relative to the connecting port in the connected operating mode substantially independent of any vehicle movements.

The vehicle docking module allows to correctly connect the portable loudspeaker to the vehicle and thus to the first tube provided in the vehicle so that the Helmholtz resonance can be used when the portable loudspeaker is located in the vehicle docking module.

Furthermore, a system comprising the portable loudspeaker and the vehicle docking module is provided.

It is to be understood that the features mentioned above and features yet to be explained below can be used not only in the respective combinations indicated, but also in other combinations or in isolation without departing from the scope of the present application. Features of the above-mentioned aspects and embodiments described below may be combined with each other in other embodiments unless explicitly mentioned otherwise.

Other features and advantages will become apparent to one with skill in the art upon examination of the following detailed description and figures. It is intended that all such additional features and advantages be included within this description, be within the scope of the invention and be protected by the following claims.

BRIEF DESCRIPTION OF THE DRAWINGS

The foregoing additional features and effects of the application will become apparent from the following detailed description when read in conjunction with the accompanying drawings in which like reference numerals refer to like elements.

DETAILED DESCRIPTION

Figure 1:
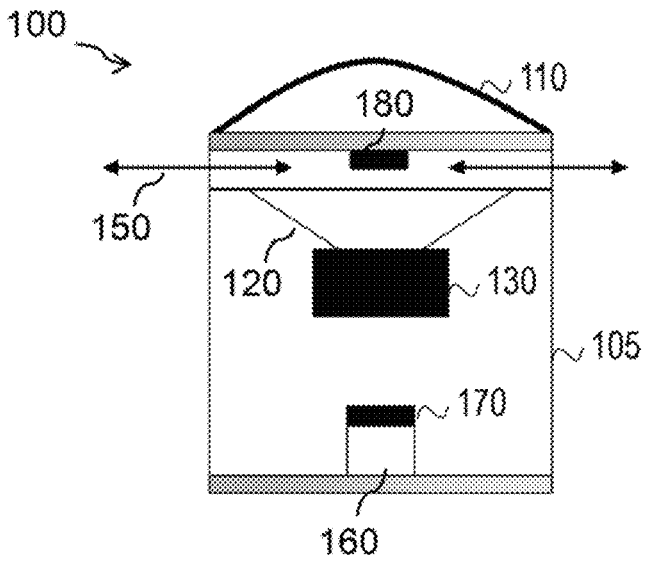
FIG. 1 shows a schematic sectional view of a portable loudspeaker comprising a port with which the portable loudspeaker can be connected to a vehicle cavity and a closing element configured to open and close the port.

In the following, embodiments of the invention will be described in detail with reference to the accompanying drawings. It is to be understood that the following description of embodiments is not to be taken in a limiting sense. The scope of the invention is not intended to be limited by the embodiments described hereinafter or by the drawings, which are to be illustrative only.

The drawings are to be regarded as being schematic representations, and elements illustrated in the drawings are not necessarily shown to scale. Rather the various elements are represented such that their function and general-purpose becomes apparent to a person skilled in the art. Any connection or coupling between functional blocks, devices, components of physical or functional units shown in the drawings and described hereinafter may be also implemented by an indirect connection or coupling. A coupling between components may be established over a wired or wireless connection. Functional blocks may be implemented in hardware, software, firmware, or a combination thereof.

FIG. 1 is a schematic view of a portable loudspeaker 100 which can operate as a normal portable loudspeaker in a stand-alone operating mode. The portable loudspeaker 100 can comprise a carrying handle 110 a diaphragm 120 and a magnet module 130. Furthermore, bass vents 150 may be provided through which the air of the portable loudspeaker can circulate. As far as the components described above are concerned these components are components of a portable loudspeaker known in the art and are thus not explained in further detail as the normal functioning of a portable loudspeaker is known to a person skilled in the art. The portable loudspeaker has a housing 105 which is a sealed box as far as the lower part of the portable loudspeaker is concerned.

The portable loudspeaker additionally comprises a port 160 and a valve 170 which is configured to open and close the port. In the embodiment shown in FIG. 1, the port is shown in a closed state in which the valve 170 operating as closing element seals the lower part of the portable loudspeaker. The port 160 provides an opening to a space outside of the housing 105.

Figure 2:
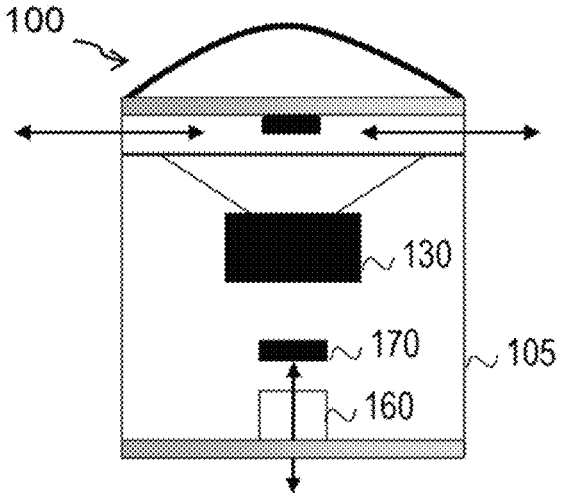
FIG. 2 shows a further schematic view of the portable loudspeaker of FIG. 1 with the closing element being in an open state.

In FIG. 2, the port is shown in an open state in which the valve 170 or closing element is positioned such that air can move from inside the housing 105 to a space outside the housing as indicated by arrow 170. As will be discussed in connection with FIGS. 3 to 5, the valve is opened when the portable loudspeaker 100 shown in FIGS. 1 and 2 is connected to a vehicle docking module.

Figure 3:
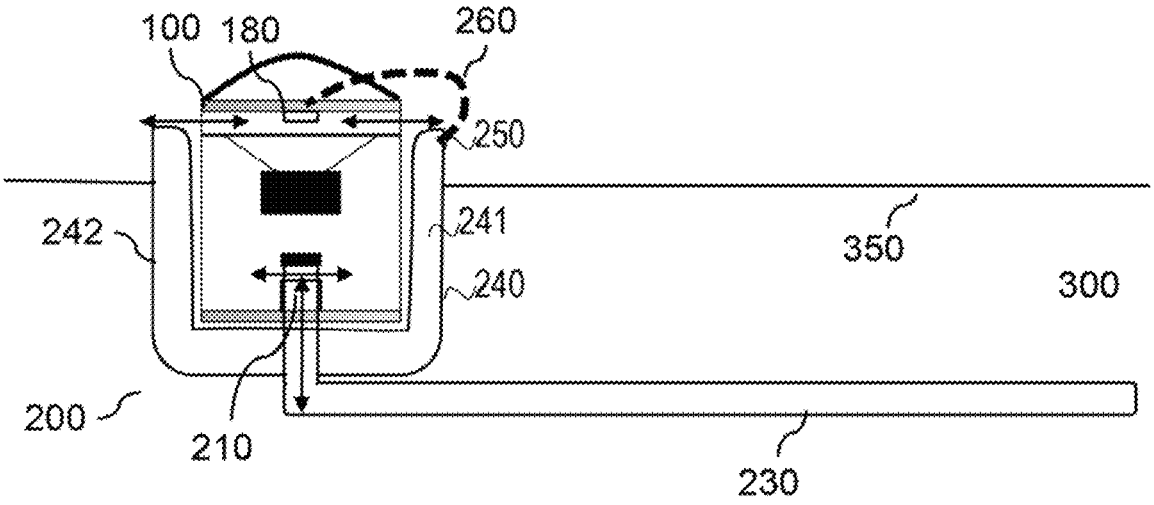
FIG. 3 shows a schematic sectional view of a system in which the portable loudspeakers of FIGS. 1 and 2 is connected to a vehicle docking module.

FIG. 3 shows a vehicle docking module 200 to which the portable loudspeaker 100 is connected. The docking module comprises a connecting port 210 by which the valve 170 is opened when the portable loudspeaker 100 is connected to the docking module 200. The docking module 200 can be provided in a trunk of a vehicle, by way of example, in a side part of the trunk near and above the wheels. The docking module 200 comprises a first tube 230 through which the air coming from the portable loudspeaker through the port 160 and the connecting or tuning port 210 can pass. The first tube 230 has an open end which leads to a free space 300 in the vehicle. The available cavities (space to position the port and the first tube) in the vehicle can be in the rear cross member below and behind the trunk floor, above the wheel arc behind the side panels, or the spare wheel compartment or below the rear seat. In theory any available space behind the main surface panels 350 or below seats can be used for the port and the tube. The connecting port itself is accessible to a user of the portable loudspeaker so that the portable loudspeaker can be connected to the connecting port. The other elements of the docking module are not necessarily accessible to the user and are located behind at least one vehicle panel provided inside the vehicle. The first tube 230 can open into any free space 300 provided between an outside panel responsible for an outer appearance of the vehicle and an inner panel provided inside the vehicle. The free space as such can be the full vehicle cabin. The first tube may have any shape and may be rectilinear or may have a curved shape.

The port 160 has an opening of a certain dimension and the first tube 230 also has a certain length.

By way of example, the port may have a circular or elliptical cross-section. The first tube 230 must have a length necessary to obtain the right tuning frequency without audible noise. The length may have to be over 2 m, but if designed and positioned correctly in the vehicle the length may be smaller than 50 cm. When the portable loudspeaker is connected to the docking module 200 the portable loudspeaker can operate in a connected operating mode using the Helmholtz resonance in which the frequencies generated by the components such as port, connecting port and tube generate an additional sound signal component of a certain frequency which depends on the geometry used. The known math of the Helmholtz resonance effect shows that for a bass enhancement system normally a port of the size of 1.5 m would be necessary which may be possible in a vehicle environment as it can be hidden behind panels, but smaller ports are preferred. As indicated above, the port is much smaller in the range of several centimeters below 10 cm, so that additional disturbing noise components will be generated by the system as shown in FIG. 3. However, the enclosing components of the vehicle such as the components in the trunk and the other components in the vehicle compartment will dampen the higher frequency components to such an extent that they cannot be heard by a user when the portable loudspeaker is used in the connected mode. Only the low frequency components between approximately 60 and approximately 30 Hz are transmitted nearly without attenuation through the vehicle components such as seat cushions etc.

The docking module comprises a support structure 240 with side walls 241 and 242 which keep the portable loudspeaker in a stable position on the docking module. The docking module furthermore comprises a power supply 250, by way of example a USB connection, by way of example a USB-C connector so that using cable 260 power can be supplied to the portable loudspeaker using USB connector 180 of the portable loudspeaker. It should be understood that the connector 250 can also provide the sound signal to be emitted by the portable loudspeaker.

Figure 4:
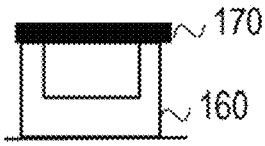
FIG. 4 shows a detailed view of a port of the portable loudspeaker in a closed state.
Figure 5:
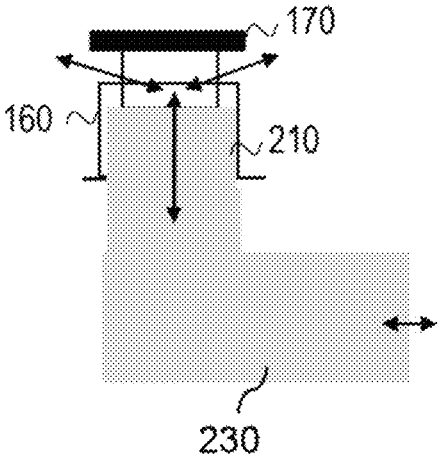
FIG. 5 shows a schematic view in which the port is in the open state when connected to the vehicle docking module.

FIG. 4 shows a more detailed view of the port 160 and the valve 170 in the closed state so that no air can move through the port 160 to the outside. In this situation, the portable loudspeaker 100 can be used in the stand-alone operating mode. In connection with FIG. 5 it is schematically shown how in the connected operating mode the connecting port 210 opens the valve 170 so that in the connected operating mode air can move in and out of the port to the first tube 230. In the embodiment shown, a valve may be used which is pressed on to the port either by magnetic force, by a spring etc. The element closing or opening the port may be a pure mechanical element, however it may also be controlled electronically and may be controlled from the outside so that the port can be closed and opened by a control means not shown in the figures and not by the connecting part 210.

Figure 6:
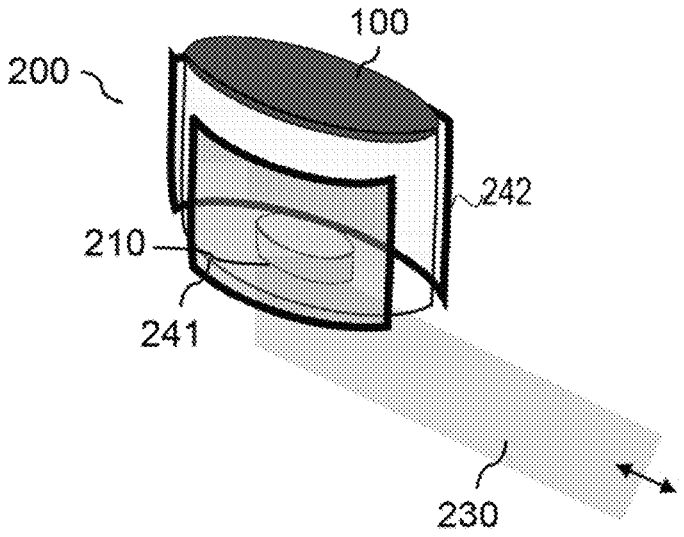
FIG. 6 shows a schematic perspective view of the system in which the portable loudspeaker is connected to the vehicle docking module.

FIG. 6 shows a perspective view of a system comprising the portable loudspeaker 100 and the docking module 200 with the sidewalls 241 and 242 which shows that the side walls are configured to fix the support the portable loudspeaker 100 on the docking module 200. Side walls are arranged such that a movement of the environment, e.g. of the vehicle itself or of vibrations occurring in the vehicle during a normal driving situation do not alter the position of the portable loudspeaker relative to the vehicle docking module 200.

Figure 7A:
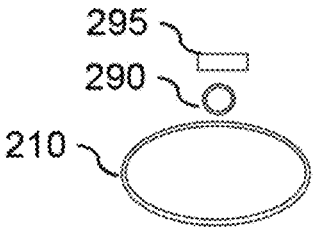
FIG. 7A shows a bottom view of connecting elements provided in the vehicle docking module and the portable loudspeaker.
Figure 7B:
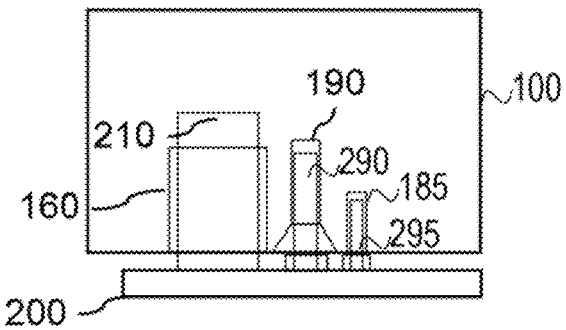
FIG. 7B shows a side view of connecting elements provided in the vehicle docking module and the portable loudspeaker.

FIG. 7A shows a bottom view of parts of the portable loudspeaker of a further example which make sure that the portable loudspeaker can only be connected to the docking module 200 in a single orientation. The left side the port 160 is shown and a guiding element 190. Furthermore, a USB port 195 may also be provided on the bottom of the portable loudspeaker. In this example the USB port is provided on the lower surface whereas in the other example described above, the USB port was provided in the upper surface of the portable loudspeaker 100. The connection can be any; USB or other and positioned anywhere. In FIG. 7B it is shown how the portable loudspeaker is connected to the docking module 200 with the connecting port 210 and a positioning element 290 which cooperates with the guiding element 190. Furthermore, the USB connection 250 may be provided configured to provide power and/or audio signals. The vehicle may have its own audio system but may not have a sub-woofer providing the low frequencies as discussed above.

Figure 8A:
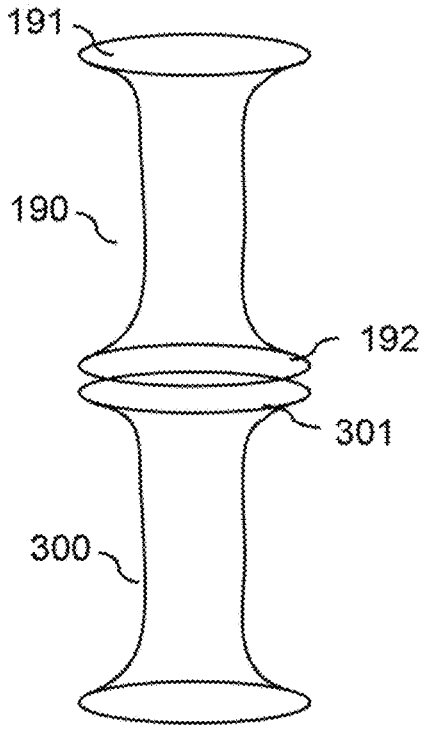
FIG. 8A shows a schematic view of a further possibility of using tubes to connect the soundwaves from the portable loudspeaker to the vehicle.
Figure 8B:
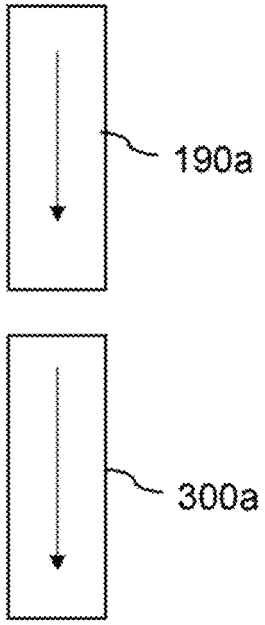
FIG. 8B shows a comparison of soundwave velocities.
Figure 9:
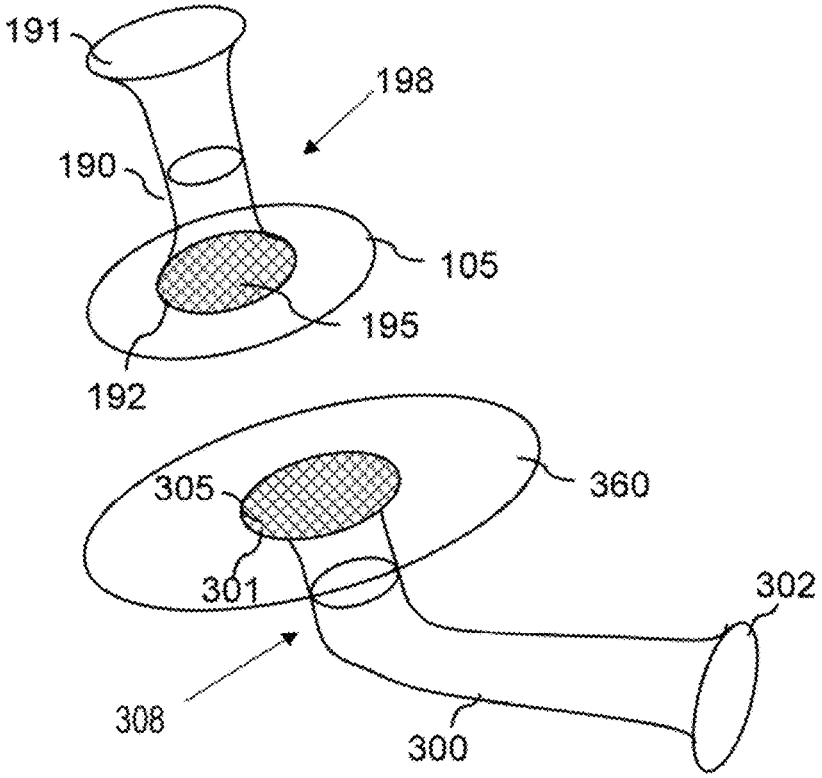
FIG. 9 shows a schematic embodiment of the coupling of the portable loudspeaker to the vehicle using tubes as shown in FIG. 8.

FIGS. 8A and 9 show another embodiment in which flared tubes are used to guide the soundwaves from the portable loudspeaker to the vehicle docking module. In the embodiment shown, two open tubes 190 and 300 are used. Each of the tubes has the largest diameter part at its end, such as 191 and 192 or ends 301 and 302. Due to the larger surface area the velocity of the soundwaves in the transition area is low and lower compared to the other sections of the tube. Accordingly, the soundwaves are not influenced by the transition areas between the tube or at the entrance of the tube's first end 191 where the sound waves enter the tubes. FIG. 8B shows a comparative example with tube 190*a* and 300*a*. As shown the velocity is constant in both tubes also in the transition area and turbulences may occur at the connecting part connecting the tubes.

FIG. 9 shows an embodiment using the flared tubes of FIG. 8A. In the portable loudspeaker there is provided tube 190 and the end 192 with the largest diameter plays the role of the port in the portable loudspeaker. Accordingly, instead of using the port 160 and the closing element 170 the flared tube 190 is used. The flared tube 190 is used instead of port 160 and the closing element 170 and the soundwaves leave the portable loudspeaker at the end 192. A grille 195 can be provided which avoids unwanted items to enter the portable loudspeaker. Furthermore, the housing 105 is partly shown showing the location of the tube 190 inside the portable loudspeaker. Accordingly, the end of the tube 192 is substantially flush with the outer surface of the portable loudspeaker. Both ends 191 and 192 could have the same surface, however it is also possible that one end has a larger diameter surface compared to the other end.

At the vehicle side the first tube 300 is also configured as a flared tube. As in the first embodiment discussed in FIGS. 1 to 7, the end 302 opens to the free space in the vehicle behind the vehicle compartment Furthermore the surface 360 is shown which is the outer surface or panel similar to panel 350 shown in FIG. 3. Additionally, a grille 305 may be provided which keeps unwanted items out of the tube. In the connected state the end 192 of the tube 190 is located directly on the end 301 of the other tube 300 so that the surface 105 lies upon surface 360 and no free space is provided between end 192 and end 301. Accordingly, the space 198 is inside portable loudspeaker 100 and the space 308 is behind the vehicle panel. In this embodiment there may be no mechanical connection at the 2 tubes which connect the two tubes. The connection between the portable loudspeaker and the vehicle docking module may be obtained by other connecting elements provided at other parts of the system.

In this embodiment the portable loudspeaker, in the stand-alone operating mode is not closed, but due to the shape of the tube, the portable loudspeaker can nevertheless does work with an acceptable sound quality even though no closed space is provided inside the portable loudspeaker.

Figure 10:
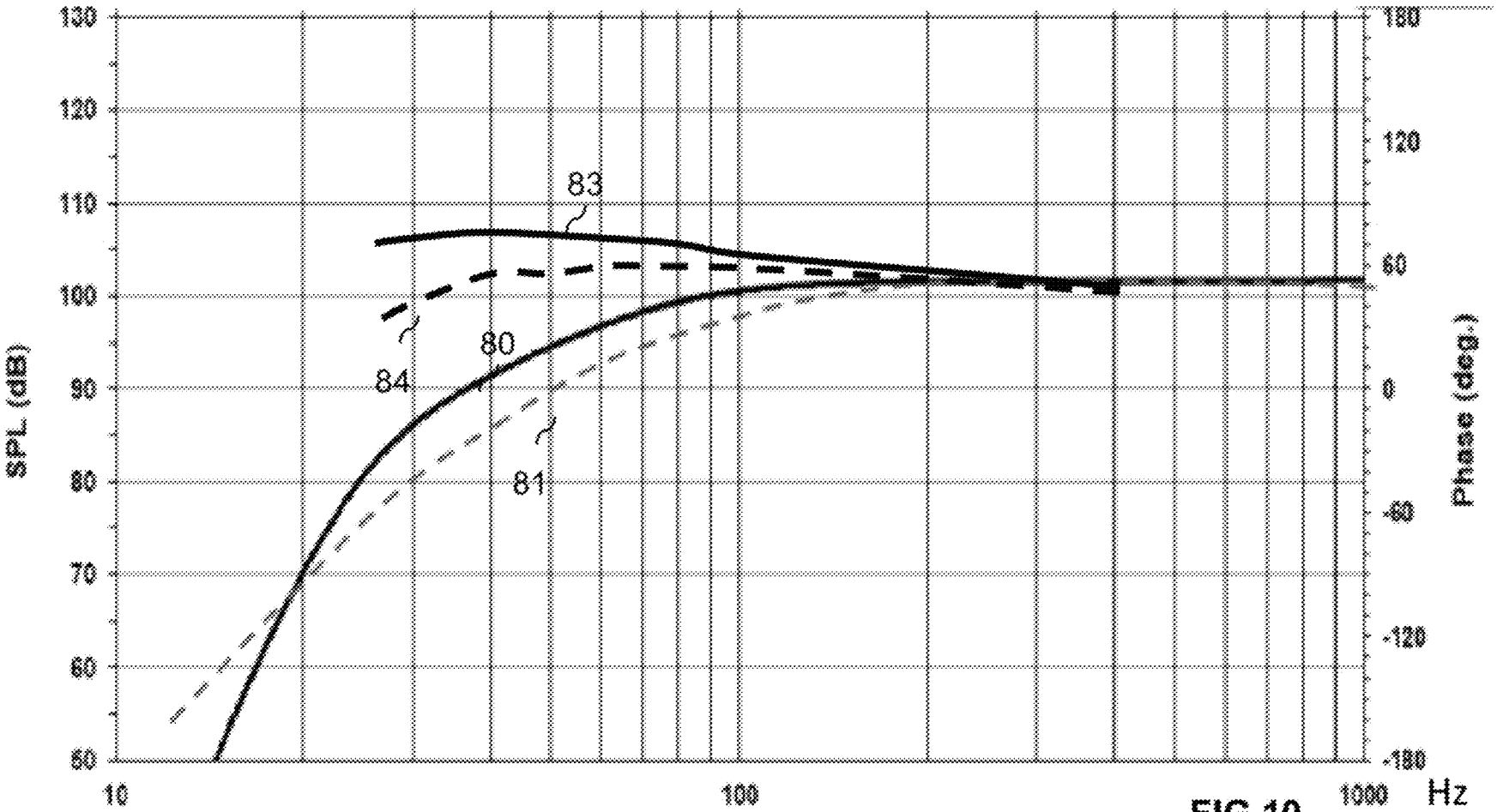
FIG. 10 shows the frequency characteristics of the portable loudspeaker in the stand-alone and in the connected operating mode.

FIG. 10 shows a comparison of the frequency characteristic of the portable loudspeaker in the closed or connected operating mode. Graph 80 shows the frequency characteristic in the connected operating mode whereas 81 shows the frequency characteristic in the stand-alone operating mode. As can be seen, in the frequency range below 100 Hz the system operating in the connected operating mode has more bass output especially in the range between 30 and 100 Hz. Curve 83 shows an estimated curve with a typical cabin load in the connected operating mode comprising all the typical elements such as seats in the vehicle cabin compared to curve 84 describing the curve in the stand-alone operating mode with a typical cabin load. The difference is up to 6 DB at around 30 Hz which is a considerable difference in sound pressure level The above-described concept provides a portable loudspeaker with an enhanced bass when connected to a vehicle.

From the above discussion some general conclusions concerning the portable loudspeaker and the vehicle docking module can be drawn. As far as the portable loudspeaker is concerned, a closing element may be provided configured to provide the port in a closed state in which the housing is a sealed housing when the portable loudspeaker is operating in the stand-alone operating mode, and configured to provide the opening in an open state allowing the circulation of the air through the opening.

The closing element may be configured such as to keep the port in a closed state when the portable loudspeaker is operating in the stand-alone operating mode. In addition, the closing element may be configured to keep the port 160 in the open sate when the portable loudspeaker 100 is operating in the connected operating mode.

Furthermore, the portable loudspeaker may comprise a guiding element such as guiding element 190 shown in FIG. 7 to allow a single orientation of the portable loudspeaker relative to the vehicle docking module 200 and as a consequence relative to the tube 230 in the vehicle when operating in the connected operating mode in which the portable loudspeaker is connected via the external connecting port 230.

The portable loudspeaker may furthermore comprise a USB connector configured to receive charging power for the portable loudspeaker from outside the portable loudspeaker.

Furthermore, the port may comprise a second tube configured to guide the air to the opening, wherein the diameter of the tube increases in direction of the opening. This second tube may be a flared tube with the largest diameter being provided at the end of the tube, wherein one end of the second tube is provided at the opening. As discussed in connection with FIGS. 8 and 9, the tube in the portable loudspeaker, also called second tube, may be used instead of the closing element.

As far as the vehicle docking module 200 is concerned, tube 230 extends from the connecting port 210 to another open end of the tube which leads to a free space behind the inner panel. The tube may have a length lying in the interval between 0.5 and 3 m. depending on the amount of bass enhancement needed.

The support walls 241, 242 of the support structure can extend in a direction in which the external portable loudspeaker is connected to the vehicle docking module over at least 5 cm, preferably over at least 10 cm in order to make sure that a stable orientation of the portable loudspeaker in a moving environment is obtained.

The docking module can further comprise the USB connector configured to provide charging and operating power to the portable loudspeaker in the connected operating mode.

The support walls 241, 242 can extend in the connected operating mode over at least half of the lengths of the housing of the portable loudspeaker in order to provide a stable positioning and orientation of the portable loudspeaker in the docking module 200.

In the connected operating mode, the portable loudspeaker 100 is outputting the sound signal using the port 160 of the portable loudspeaker 100 the connecting port 210 and the tube 230 to guide the sound waves.

The connecting port 210 may be configured such that it opens the closing element of the portable loudspeaker when the portable loudspeaker is connected to the vehicle docking module.

As discussed above, in the connected frequency characteristic the frequencies below 100 Hz are enhanced compared to the stand-alone frequency characteristic.

Furthermore, the positioning element 190 and the guiding element 290 can cooperate to allow only a single orientation of the portable loudspeaker relative to the vehicle or docking module 200.

The tube in the vehicle docking module may be configured such that the first tube 230 extends from the connecting port 210 to another open end of the first tube which leads to a free space 300 behind the inner panel, wherein the tube 230 has a length laying in an length interval between 0.5 and 3 m, preferably between 0.5 and 1 m.

One end of the first tube can play the role of the connecting port, and the diameter of the first tube increases in direction of the connecting port, wherein at least one part with the largest diameter of the first tube is provided at the end of the first tube.

The end of the tubes facing the other tube can each comprise a grille in order to avoid unwanted objects entering the tubes.

The above-described concepts provide a portable loudspeaker having an enhanced bass while connected to the car.

In the foregoing specification, the present disclosure has been described with reference to specific exemplary embodiments. Various modifications and changes may be made, however, without departing from the scope of the present disclosure as set forth in the claims. The specification and figures are illustrative, rather than restrictive, and modifications are intended to be included within the scope of the present disclosure. Accordingly, the scope of the present disclosure should be determined by the claims and their legal equivalents rather than by merely the examples described.

The components and/or elements recited in any apparatus claims may be assembled or otherwise operationally configured in a variety of permutations and are accordingly not limited to the specific configuration recited in the claims.

Benefits, other advantages and solutions to problems have been described above with regard to particular embodiments; however, any benefit, advantage, solution to problem or any element that may cause any particular benefit, advantage or solution to occur or to become more pronounced are not to be construed as critical, required or essential features or components of any or all the claims.

The terms "comprise", "comprises", "comprising", "having", "including", "includes" or any variation thereof, are intended to reference a non-exclusive inclusion, such that a process, method, article, composition or apparatus that comprises a list of elements does not include only those elements recited, but may also include other elements not expressly listed or inherent to such process, method, article, composition or apparatus. Other combinations and/or modifications of the above-described structures, arrangements, applications, proportions, elements, materials or components used in the practice of the present disclosure, in addition to those not specifically recited, may be varied or otherwise particularly adapted to specific environments, manufacturing specifications, design parameters or other operating requirements without departing from the general principles of the same.

The invention claimed is:

1. A portable loudspeaker, comprising:

a housing;

a sound generating unit configured to output a sound signal with a stand-alone frequency characteristic when the portable loudspeaker is used in a stand-alone operating mode and a connected frequency characteristic when the portable loudspeaker is used in a connected operating mode;

a port having an opening to a space outside the housing allowing a circulation of air through the opening when the portable loudspeaker is operating in the connected operating mode in which the portable loudspeaker is connected through the port to a first flared tube provided in a vehicle, the first flared tube is connected to the opening in the port by a second flared tube in the port, wherein the first and second flared tubes connect to each other at a part of each tube that has the largest diameter;

in the connected operating mode, the portable loudspeaker outputs the sound signal with the connected frequency characteristic using the sound generating unit and the first and second flared tubes provided in the vehicle, the connected frequency characteristic has an enhanced bass output compared to the stand-alone frequency characteristic.

2. The portable loudspeaker according to claim I, further comprising a guiding element to allow only a single orientation of the portable loudspeaker in the connected operating mode in which the portable loudspeaker is connected to the first flared tube via an external connecting port provided in the vehicle.

3. The portable loudspeaker according to claim 1, further comprising a USB connector to receive charging power for the portable loudspeaker from outside the portable loudspeaker.

4. The portable loudspeaker according to claim I, further comprising a closing element to provide the port in a closed state in which the housing is a sealed housing when the portable loudspeaker is operating in the stand-alone operating mode, and the closing element configured to provide the opening in an open state allowing the circulation of the air through the opening.

5. The portable loudspeaker according to claim 4, wherein the closing element is configured to keep the port in the closed state when the portable loudspeaker is operating in the stand-alone operating mode.

6. A docking module for docking a portable loudspeaker in a vehicle, the docking module comprising:

a connecting port in the vehicle, the connecting port connects sound waves emitted by the portable loudspeaker in a connected operating mode to an area behind an inner panel of the vehicle;

a first flared tube connected between a second flared tube in the connecting port and the inner panel of the vehicle, the first and second flared tubes are connected to each other at a part of each tube that has the largest diameter. sound waves emitted by the portable loudspeaker pass through the first and second flared tubes in the connected operating mode;

a positioning element arranged relative the connecting port such that only a single orientation of the portable loudspeaker is allowed when the portable loudspeaker is connected to the connecting port; and a support structure having support walls, when the portable loudspeaker is connected to the connecting port the support walls keep the portable loudspeaker at a fixed position relative to the connecting port independent of vehicle movements.

7. The docking module according to claim 6, wherein the support walls extend at least 0.05 m in a direction in which the portable loudspeaker is connected to the vehicle docking module.

8. The docking module according to claim 6, further comprising a USB connector to provide charging and operating power to the portable loudspeaker when the portable loudspeaker is connected to the connecting port.

9. The docking module of claim 6, wherein the first tube has first and second open ends, the first end of the first tube extends from the connecting port to the second end of the first tube which leads to a free space behind the inner panel, the first tube has a length between 0.5 and 3 m.

10. The vehicle docking module according to claim 6, wherein a grille is provided at the first end of the tube.

11. A system for docking a portable speaker in a vehicle, the system comprising:

a portable loudspeaker having a housing, the housing has a port operable in between a first position and a second position, the second position of the port exposes an opening in the port to a space outside of the portable loudspeaker housing to allow air circulation through the opening in the port;

a docking module in the vehicle having a connecting port to receive the portable loudspeaker;

a first flared tube in the vehicle behind an inner panel of the vehicle and connected to the connecting port of the docking module;

a second flared tube in the connecting port of the portable loudspeaker, the first and the second flared tubes are connected to each other at a part of each tube that has the largest diameter;

a stand-alone operating mode of the portable loudspeaker having a stand-alone frequency characteristic defined by the first position of the port when the portable loudspeaker is not connected to the connecting port of the docking module; and a connected operating mode of the portable loudspeaker having a connected frequency characteristic defined by the second position of the port, the port moves into the second position when the portable loudspeaker is connected to the connecting port of the docking module, in the connected operating mode, the portable loudspeaker outputs a sound signal using the port of the portable loudspeaker, the connecting port of the docking module, and the first and second flared tubes to guide sound waves to a space outside of the portable loudspeaker housing; and a bass output of the connected frequency characteristic is enhanced as compared to a bass output of the stand-alone frequency characteristic.

12. The system according to claim 11, wherein the docking module further comprises support walls that extend over at least half of a length of the housing of the portable loudspeaker.

13. The system according to claim 11, wherein the connecting port of the docking module is configured such that it moves the portable loudspeaker port into the second position when the portable loudspeaker is connected to the connecting port of the docking module.

14. The system according to claim 11, in the connected operating mode, any frequencies of the connected frequency characteristic that are below 100 Hz are enhanced as compared to the stand-alone frequency characteristic.

15. The system according to claim 11, further comprising:

a guiding element on the portable loudspeaker;

a positioning element on the docking module; and the guiding element cooperates with the positioning element to allow only a single orientation of the portable loudspeaker relative to the vehicle.

* * * * *